United States Patent [19]

Weigel

[11] Patent Number: 4,618,768

[45] Date of Patent: Oct. 21, 1986

[54] THERMAL IMAGING DEVICE HAVING NON-ORTHOGONAL SCAN POSITION SENSOR TO SCANNING MIRROR BEAM PATH ANGLE

[75] Inventor: Wolfgang Weigel, Dossenheim, Fed. Rep. of Germany

[73] Assignee: Hughes Aircraft Company, Los Angeles, Calif.

[21] Appl. No.: 670,438

[22] Filed: Nov. 9, 1984

[30] Foreign Application Priority Data

Nov. 12, 1983 [DE] Fed. Rep. of Germany ..... 3341066

[51] Int. Cl.[4] ..... G02B 23/02

[52] U.S. Cl. ..... 250/334; 250/332

[58] Field of Search ..... 250/334, 347, 332; 350/6.5; 356/138, 154

[56] References Cited

U.S. PATENT DOCUMENTS 3,552,857 1/1971 Hock et al. .

3,912,927 10/1975 Hoffman, II ..... 250/234

FOREIGN PATENT DOCUMENTS 2097150 10/1982 United Kingdom ..... 350/6.5

OTHER PUBLICATIONS

G. S. K. Wong, "A Sensitive Null-Setting Angle Detector" *Journal of Physics E*, vol. 4, No. 3 (Mar. 1971), pp. 195–197.

*Primary Examiner*—Janice A. Howell

*Assistant Examiner*—Constantine Hannaher

*Attorney, Agent, or Firm*—Thomas N. Giaccherini; A. W. Karambelas

[57] ABSTRACT

A thermal imaging device uses a scanning mirror (2) to guide incident radiation to a detector array (4) which, after optoelectronic conversion, drives a light-emitting diode array (6) synchronously; this image is represented via the back of the scanning mirror on the imaging optical system (9). On the visual collimator side of the scanning mirror, a scan position sensor (12) including a light source (**12*a*) is provided in addition to a detector (12*b*), a beam splitter (12*d*), and a collimator objective (12*c*). A plane plate (7) which operates as a dichroic beam splitter is shown between the scanning mirror (2) and the light-emitting diode array (6). Another dichroic beam splitter (8) is shown between the scanning mirror (2) and the scan position sensor (12**). Autocollimation is obtained since both beam splitters reflect the radiation from the light source in the direction of the scanning mirror. When the scanning mirror is deployed in a predetermined mirror position, the light source can be imaged on the associated detector. The great advantage of this invention is that the sensor can be arranged at any beam path angle relative to the scanning mirror as opposed to the rigid requirement of a perpendicular beam path angle in prior devices.

17 Claims, 2 Drawing Figures

THERMAL IMAGING DEVICE HAVING NON-ORTHOGONAL SCAN POSITION SENSOR TO SCANNING MIRROR BEAM PATH ANGLE

BACKGROUND OF THE INVENTION

Applicant hereby claims the benefit of the filing date of a prior foreign application in accordance with the provisions of 35 USC §119. West German Patent Application No. P 33 41 066.6 was filed in West Germany on Nov. 12, 1983.

1. Field of the Invention

The invention relates to thermal imaging devices and, more specifically, to thermal imaging devices in which radiation from a scan position sensor is not limited to traversing a beam path which is orthogonal to the normal axis of a scanning mirror in its rest position.

2. Description of the Technology

The present invention constitutes an improvement over the thermal imaging device disclosed in West German Patent Application No. P 33 29 590.5 and its corresponding U.S. patent application, Ser. No. 641,525, filed on Aug. 16, 1984. The preceding disclosure describes a thermal imaging device in which the operating axis of a scan position sensor must be aligned perpendicular to the rest position of the scanning mirror of the thermal imaging device.

SUMMARY OF THE INVENTION

For constructional reasons this perpendicular configuration is not suitable for all device configurations. The problem underlying the invention is to enable the use of a scan position sensor whose beam path permits an angle with respect to the scanning mirror differing substantially from 90°, which constitutes an important and significant improvement over the prior device. The arrangement disclosed in the previous patent application noted above requires the mirror and the sensor to be arranged at a right angle, or at most a very close angle within the narrow range of 89° to 91°. The present invention allows for substantially any beam path angle.

An appreciation of other aims and objects along with a more complete and comprehensive understanding of the present invention may be achieved through the study of the following description of a preferred embodiment in addition to reference to the accompanying drawing.

DESCRIPTION OF A PREFERRED EMBODIMENT

Figures 1, 2:
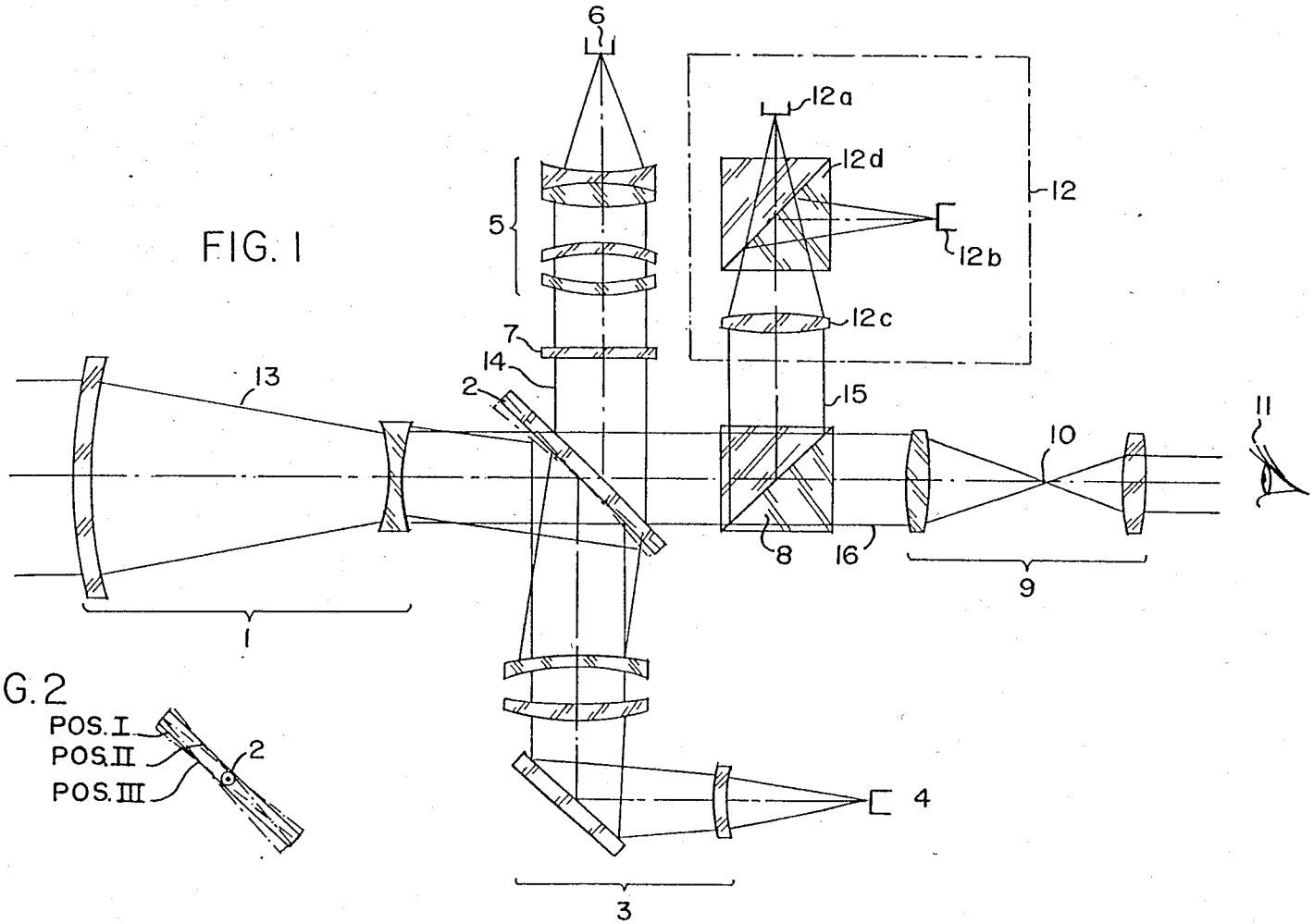
FIG. 1 is a schematic illustration of the thermal imaging device.
FIG. 2 shows the three characteristic positions of the scanning mirror according to FIG. 1 shown on its own in larger scale.

FIG. 1 illustrates a sighting device employing the principle of thermal imaging in which radiation is incident into the infrared telescope 1 of the device. The radiation 13 emerging in an afocal manner at the telescope is conducted by scanning mirror 2 which is disposed in its rest position of 45° to both the incoming beam and to the right-angle infrared objective 3. Detector array 4 employs optoelectronic conversion to synchronously drive the light-emitting diode array 6, which is laid out in accordance with the detector array 4. The visual collimator side of scanning mirror 2 is the side nearest beam splitter 8. The light-emitting diode array 6 is scanned with the visual collimator side of the scanning mirror via the objective 5. An image is represented to the observer 11 via the dichroic beam splitter 8 by means of the imaging optical system 9. Also present on the visual collimator side of the scanning mirror is the scan position sensor 12, which is made up essentially of light source **12*a* and detector 12*b* which are disposed above the beam splitter 12*d* in the image plane of the optical system 12*c***. With this sensor, when autocollimation with the scanning mirror is established, a trigger signal can be initiated.

In FIG. 2, the zero position of the scanning mirror 2 designated by I with full line is shown separately in larger scale. Also, in dashed line the two end deflections II and III are indicated. To determine, for example, the zero position I, the objective 5, disposed in FIG. 1 between the scanning mirror 2 and the light-emitting diode array 6, operates as a collimator which conducts the radiation via the plane plate 7, which acts as beam splitter, to the rear side of the scanning mirror and the observer 11. In the preferred embodiment, the plane plate reflects the wavelength of approximately 560 nm (green color) and transmits that of approximately 670 nm (red color).

The light source **12*a* of the scan position sensor 12 is a light-emitting diode. The detector 12*b* is a phototransistor. The beam splitter 12*d* disposed between the light-emitting diode and phototransistor divides the energy in the ratio of one to one. In the preferred embodiment, both elements operate in the wavelength range of 560 nm. The dichroic beam splitter 8, disposed between the visual collimator side of the scanning mirror 2 and the imaging optical system 9, transmits the radiation 16 of wavelength 670 nm coming from the light-emitting diode array 6, while the beam splitter reflects the radiation 15 with the wavelength 560 nm coming from the scan position sensor 12. Thus, the radiation of the light-emitting diode array 6 passes to the observer 11. The radiation 15 of the light source 12*a*, however, passes via the beam splitter 12*d* and collimator objective 12*c* to the dichroic beam splitter 8. The beam splitter reflects the radiation through 90°, and then it passes via the visual collimator side of the scanning mirror 2 to the plane plate 7. The radiation is then imaged via the scanning mirror, dichroic beam splitter, collimator objective and beam splitter onto the detector 12*b***. In other examples of the preferred embodiment, other wavelength ranges are, of course, conceivable within the scope of this invention. Such other operating wavelengths may be easily accommodated by varying the specifications of the light-emitting diode, phototransistor and dichroic beam splitter.

In the assumed zero position I (FIG. 2) of the scanning mirror 2, the radiation 15 emitted by the light source **12*a* is imaged on the detector 12*b*, in order to obtain autocollimation. This detector signal thus represents a predetermined mirror position in the position I. If a correspondingly dimensioned aperture or slit diaphragm is arranged in front of the detector, the mirror position can be sensed in angular second accuracy. Since the plane plate 7** can be adjusted both in the beam traveling direction and transversely thereof, the positions I and III and any other positions of the scanning mirror can be sensed.

Although the present invention has been described in detail with reference to a particular preferred embodiment, persons having ordinary skill in the art will appreciate that various modifications and alterations may be made without departing from the spirit and scope of the invention.

What is claimed is:

1. An improved thermal imaging device including:

an infrared telescope for receiving an incident beam of radiation;

a scanning mirror in optical alignment with said infrared telescope for directing said incident beam of radiation;

said scanning mirror being disposed at a rest position which is inclined at an angle of 45 degrees to said incident beam of radiation;

said scanning mirror further having a visual collimator side facing a beamsplitter and an imaging optical system including an eyepiece, both in optical alignment with said scanning mirror;

an infrared objective in optical alignment with said scanning mirror;

a detector array for receiving radiation which is optoelectronically converted and then represented by a corresponding light emitting diode array in optical alignment with said scanning mirror;

said light emitting diode array being capable of emitting a plurality of l.e.d. output light beams that are collected by an objective, directed onto said visual collimator side of said scanning mirror, and transmitted through said dichroic beamsplitter to said eyepiece; and a scan position sensor including:

a light source for irradiating said visual collimator side of said scanning mirror and a scan position sensor detector for sensing radiation and for generating a trigger signal when said detector senses radiation;

the improvement comprising:

said light emitting diode array being capable of emitting said plurality of l.e.d. output light beams that are further passed through an l.e.d. collimator objective and a plane plate and are also directed to impinge upon said visual collimator side of said scanning mirror;

said light source within said scan position sensor further being capable of also irradiating said plane plate through said beamsplitter; and said plane plate being disposed to reflect a plurality of beams of incident radiation through said beamsplitter in order to conduct said plurality of beams of incident radiation to said scan position sensor detector of said scan position sensor.

2. A thermal imaging device according to claim 1, in which said plane plate is displaceable in the beam travel direction and transversely thereto for the purpose of adjustment.

3. A thermal imaging device according to claim 1, in which said scan position sensor includes a light source and a detector which are located above a beam splitter in the image plane of a collimator objective.

4. A thermal imaging device according to claim 1, in which said scan position sensor operates in both the visible and the near infrared range.

5. A thermal imaging device according to claim 2, in which said scan position sensor operates in both the visible and the near infrared range.

6. A thermal imaging device according to claim 3, in which said scan position sensor operates in both the visible and the near infrared range.

7. A thermal imaging device according to claim 1, in which said plane plate and said dichroic beam splitter both reflect radiation of relatively short wavelengths and transmit radiation of relatively long wavelengths.

8. A thermal imaging device according to claim 2, in which said plane plate and said dichroic beam splitter both reflect radiation of relatively short wavelengths and transmit radiation of relatively long wavelengths.

9. A thermal imaging device according to claim 3, in which said plane plate and said dichroic beam splitter both reflect radiation of relatively short wavelengths and transmit radiation of relatively long wavelengths.

10. A thermal imaging device according to claim 1, in which said plane plate and said dichroic beam splitter both reflect radiation in the green range and both transmit radiation in the red range.

11. A thermal imaging device according to claim 2, in which said plane plate and said dichroic beam splitter both reflect radiation in the green range and both transmit radiation in the red range.

12. A thermal imaging device according to claim 3, in which said plane plate and said dichroic beam splitter both reflect radiation in the green range and both transmit radiation in the red range.

13. A thermal imaging device according to claim 2, in which said plane plate and said dichroic beam splitter reflect radiation of the wavelength 560 nm and are transparent to radiation of the wavelength 670 nm.

14. A thermal imaging device according to claim 3, in which said plane plate and said dichroic beam splitter reflect radiation of the wavelength 560 nm and are transparent to radiation of the wavelength 670 nm.

15. A thermal imaging device according to claim 1, in which said scan position sensor will operate in a wavelength range between 850 and 950 nm.

16. A thermal imaging device according to claim 2, in which said scan position sensor will operate in a wavelength range between 850 and 950 nm.

17. A thermal imaging device according to claim 3, in which said scan position sensor will operate in a wavelength range between 850 and 950 nm.

* * * * *